United States Patent [19]

Müller et al.

[11] 4,080,166

[45] Mar. 21, 1978

[54] EMULSIFIERS FOR DYEING ACCELERATORS BASED ON ALKYLNAPHTHALENES

[75] Inventors: Siegfried Müller, Kelkheim, Taunus; Gerhard Weckler, Sulzbach, Taunus, both of Germany

[73] Assignee: Hoechst Aktiengesellschaft, Frankfurt am Main, Germany

[21] Appl. No.: 657,195

[22] Filed: Feb. 11, 1976

[30] Foreign Application Priority Data

Feb. 15, 1975 Germany ..... 2506466

[51] Int. Cl.[2] ..... D06P 5/00

[52] U.S. Cl. ..... 8/174; 8/86; 8/94 A

[58] Field of Search ..... 8/174, 175, 86, 94 A

[56] References Cited

U.S. PATENT DOCUMENTS

| | | | |
|---|---|---|---|
| 2,225,960 | 12/1946 | Orthner et al. | 8/86 |
| 3,097,047 | 7/1963 | Weinstein et al. | 8/94 |
| 3,617,213 | 11/1971 | Britt et al. | 8/175 |
| 3,792,972 | 2/1974 | Brenneisen et al. | 8/94 |
| 3,918,902 | 11/1975 | Hoster et al. | 8/94 |
| 3,989,456 | 11/1976 | Vescia | 8/94 |

OTHER PUBLICATIONS

The Chem. Techn. of Dyeing & Printing 1948 Reinhold Publ. Co. pp. 8–13.

Rose The Cond. Chem. Dict. 9th Ed. (1966) Reinhold Publ. Co. p. 691.

*Primary Examiner*—William E. Schulz

*Attorney, Agent, or Firm*—Connolly and Hutz

[57] ABSTRACT

Emulsifiers for preparing dyeing accelerators (carriers) based on alkylnaphthalenes consisting of a multi-component system of (a) a mixture of sulfonated and oxylated alkylaryl compounds, (b) alkanols, (c) sodium alkylsulfonamido acetic acid, (d) partially chlorinated paraffin hydrocarbons, (e) olein and (f) water.

14 Claims, No Drawings

EMULSIFIERS FOR DYEING ACCELERATORS BASED ON ALKYLNAPHTHALENES

The use of dyeing accelerators (carriers) in the dyeing of hydrophobic fibers, particularly polyester fibers, according to the exhaust process with disperse dyestuffs from aqueous liquors under normal pressure as well as at boiling temperature, is known since these fibers are used.

Alkylnaphthalenes, preferably monomethylnaphthalenes, are also currently used as efficient carrier substances for these fibers, as per the description given by the Austrian Pat. No. 214,399.

For putting to practice the application of water-insoluble carrier substances of various kinds it is a known fact that these substances have to be dispersed uniformly in the aqueous liquors. This requirement can be met by the use of dispersants or emulisifiers which are either added directly to the carrier substance or introduced into the liquors. The carrier is then stirred into the liquors either directly or after being dissolved in a water-miscible solvent.

A series of non-ionic or anionic tensides, but also of protective colloids without a proper surface activity has been suggested and applied for this purpose as dispersants or emulsifiers.

However, the evaluation of the practical value of a carrier depends very much on the emulsifier system which is applied. Therefore, the emulsifier of an efficient carrier has to meet necessarily some general requirements:

The properly efficient carrier substance with is unsoluble in water has to be emulsifiable easily and readily at a high degree of fine dispersion and then yield emulsions which remain perfectly stable for a prolonged period under the chosen application conditions and which do not show any disassociation of the mixture.

Since practically all carrier substances being suitable for polyester fibers are derivatives of aromatic substances, their steam volatility is more or less strongly marked. Thus, part of the volatilized carrier may condense at boiling temperature on cooler parts of the machinery during the dyeing process and the condensate may drop back onto the treated material, a fact which leads — as well as a disassociation of the emulsion mixture — to the well-known undesirable carrier spots. An important assignment to the emulsifier is therefore to re-emulsify promptly and completely such a carrier condensate so as to avoid these spots, even though the carrier may occur at considerable excess in certain areas.

However, the unavoidable stream volatility of the carrier substance constitutes also an advantage insofar that the carrier quantity which had been absorbed by the fiber can be removed during the drying process together with the condense water.

The carrier preparations applied for the dyeing process have to be adjusted to a percentage ratio of carrier substance insoluble in water to emulsifier such that the fine dispersion and the stability of the emulsion remain unaffected under the working conditions, and nevertheless the degree of dispersity of the disperse dyestuff and thus its color yield are not diminished. If the carrier (and thus the emulsifier) is applied in exaggerated concentration rates, the result brings about financial and technological disadvantages due to too much expenditure and to the retention of dyestuff in the liquor. It is a known fact that some tensides though being highly efficient as emulsifiers of water-insoluble carrier substances, have a detrimental effect on the color yield in this respect, if they are used in carrier preparations in adequate concentrations without excess quantities.

Therefore, the detrimental influence acting on the finely dispersed dyestuff not only depends on the quantity of emulsifier applied but as well on its chemical properties. This is particularly true for exclusively non-ionic emulsifiers.

It has now been found that for water-insoluble carrier substances based on alkylnaphthalenes, preferably on monomethylnaphthalenes, a well-balanced multi-component system of anionic and non-ionic portions is applicable as emulsifier which not only meets perfectly the standard requirements for those products, but includes also some additional technological advantages. The carriers prepared with an emulsifier according to the invention are applied in aqueous liquors for dyeing linear polyester or cellulose triacetate fibers with disperse dyestuffs according to the exhaust process at boiling temperature and under normal pressure as well, or for levelling-up finished, non-levelled colorations with disperse dyestuffs on these fibers, e.g. due to affinity differences inherent to the material resulting in the tendency to show reed-marked effects (warp stripes) after coloration, or unevenly wound bobbins; said carriers may as well be applied under normal pressure or under high temperature (HT) dyeing conditions or in print pastes.

The methylnaphthalene carrier is prepared on the base of the commercially available mixture of 1-methylnaphthalene and 2-methylnaphthalene (methylnaphthalene oil) and the emulsifier by a simple mixing operation, possibly by homogenization with a high-speed-stirring device, the emulsifier portion representing from 30 to 40 weight % of the final product. Soft water is then added to the mixture at the rate of from 8 to 10 weight %.

The carrier is applied at the following concentration rates for dyeing polyester fibers with disperse dyestuffs: Guide value: 10% of the weight of the material at average coloration intensity and a goods-to-liquor ratio of 1:20, however not above 4 $cm^3/l$ and not below 0.5 $cm^3/l$.

These guide values are valid for dyeing under normal pressure and at boiling temperature.

As far as HT colorations are concerned, the guide value is generally not above 3 $cm^3/l$, in print pastes with disperse dyestuffs and steam fixation under pressure up to 15 $cm^3/l$, for levelling-up at boiling temperature up to 4 $cm^3/l$, under HT conditions — as experience showed — up to 3 $cm^3/l$.

The present invention is now related to emulsifiers for preparing dyeing accelerators (carriers) based on alkylnaphthalenes, consisting of a multi-component system of the following composition (weight percent):

(a) 57.0 to 51.0% of a mixture of sulfonated and oxethylated alkylaryl compounds having in the alkyl radical from 9 to 12 carbon atoms, sulfonates to oxethylates 1:1 to 3:1, (b) 15.0 to 17.0% of aliphatic alcohols having from 3 to 5 carbon atoms, (c) 2.0 to 6.0% of sodium alkylsulfonamido acetic acid, (d) 2.0 to 6.0% of partially chlorinated paraffin hydrocarbons having from 12 to 14 carbon atoms and 1.5% of chlorine, (e) 2.0 to 6.0% of olein and (f) 18.0 to 20.0% of water, whereby the individual quantities of the different components have to form a total of 100% in each case.

According to a preferred embodiment, the component (a) consists of 32 to 36% of dodecyl benzene sulfonate and 25 to 15% of nonylphenyl with 23 moles of ethylene oxide per mole (rated in weight %).

The emulsifier as per the invention is also containing the component (c) amounting to preferably from 3.0 to 4.0 weight %, particularly from 3.0 to 3.5 weight % the component (d) amounting to preferably from 3.0 to 4.0 weight %, particularly from 3.5 to 4.0 weight %, and the component (e) amounting to preferably from 3.0 to 5.0 weight % particularly from 3.5 to 4.5 weight %.

The preparation of the emulsifier comprises that the (solid) oxethylated nonylphenol is liquified by heating to 60° C, stirred into the dodecyl benzene sulfonate, and the further components are added in the specified order of succession. If the afore mentioned percentage ranges for the individual components are not maintained, the optimum efficiency of the emulsifier and/of the carrier being produced with this emulsifier is jeopardized. The application of the carrier being prepared with the emulsifier as per the invention brings about specifically some further technical advantages:

Affinity differences, due to the characteristics of the material or of the fiber, such as they result from stretchability differences within the individual fiber or from differences caused during the pretreatment under heat of the fiber and which show then as reed-marks (warp stripes) or — in case of knitted fabrics — as ring-like stripes, may be avoided or, if an irregular coloration has formed already, compensated subsequently by levelling-out. The excellent levelling capacity is an effect of the extremely fine dispersion of the carrier substance.

A novelty is the possibility that by means of the emulsifier system the equalizing effect of the carrier-active substance methyl naphthalene may be emphasized to such an extent, that a skittery appearance of the material as a result of the fiber agglutinations being always darker in coloration than the regular polyester fiber portions and of unstretched fiber portions can be practically avoided by dyeing at boiling temperature. When dyeing at 100° C and also under HT conditions (106° C to 125° C) in the presence of a usual carrier other than those of the invention, the afore described deficiencies are only partially diminished, i.e. the darker shaded zones in the colored material are still discernable and have to be painstakingly eliminated from the fabric. Yarn material having the afore described deficiencies may also be dyed flawlessly provided that processing takes places in the presence of methyl naphthalene the levelling effect of which has been enhanced by the described emulsifier system.

When dyeing on jet-dyeing apparatus being only half-flooded, the tendency to condensation and thus to the formation of carrier spots is especially heavy as soon as a concentration of 2 $cm^3/l$ of carrier has to be exceeded because of the chosen color intensity. Surprisingly, when carrying out practical experiments for comparing different conventional carriers, also those based on methyl naphthalenes with different emulsifiers, the results showed that no carrier spots are forming if methyl naphthalene-carriers based on the emulsifier of the invention are used, even though more than 3 $cm^3/l$ of carrier may be added to the liquor and even though the steam volatility cannot be influenced by the emulsifier system and although a condensate is also formed here. In the preceding case, the condensate is re-emulsified promptly and faultlessly.

Provided that the concentration rates being recommended for application of the carrier adjusted according to the invention are maintained, an optimum dyestuff yield is obtained, a fact which has been proved also by experiments on an industrial scale in comparison to other products commercially available. The improvement of the dyestuff yield results from the extremely fine dispersion of the active carrier substances in the liquor due to the emulsifier.

During the warm washing and rinsing processes which follow the dyeing or levelling processes, a part of the carrier (being absorbed by the hydrophobic fiber) is eliminated by means of the emulsifier still present in the liquor, after having adjusted a new equilibrium. This operation takes place more intensely in the presence of the emulsifier claimed herewith than with other emulsifiers.

A series of commercially available types of disperse dyestuffs display a certain degree of sensitivity as to their stability in a turbulent bath, leading to undesirable precipitations as a consequence of the particles growing coarser. This handicap is prevented to a large extent by using a carrier or emulsifier being prepared according to the invention.

The following examples illustrate the invention:

EXAMPLE 1

A mixed fabric of polyester fibers and wool (mixture 55/45) is treated for 15 minutes on a closed winch under normal pressure and at a goods-to-liquor ratio of 1:20, the treatment being carried out at first with an aqueous liquor, at 50° C, containing 1% of a 60% acetic acid
5% of crystallized sodium acetate and
3 $cm^3/l$ of a methyl naphthalene-carrier, emulsified by means of from 30 to 40% (calculated on the weight of the carrier preparation) of a multi-component system being composed of:
32 to 36% of dodecyl benzene sulfonate,
25 to 15% of nonylphenol with 23 moles of ethylene oxide per mole,
15 to 17% of aliphatic alcohols carrying from 3 to 5 carbon atoms,
3 to 3.5% of sodium alkylsulfonamide acetic acid,
3.5 to 4% of partially chlorinated paraffin hydrocarbons having from 12 to 14 carbon atoms and 1.5% of chlorine,
3.5 to 4.5% of olein and
18 to 20% of water.

The dyestuffs in their dissolved or dispersed state are then added to this liquor through a sieve, being 0.8% of a blue disperse dyestuff based on a mixture of partially brominated diamino dihydroxy anthraquinones (less than 1 atom of Br per mole)
0.3% of Disperse Yellow 64, C.I. No. 47023
0.6% of Acid Blue 123, C.I. No. 44 510 and
0.3% of Acid Yellow 44, C.I. No. 23 900.

After another 10 minutes period of first runnings, the temperature of the dyeing bath is increased at the rate of 1° to 2° C per minute. The fabric is now dyed for 60 minutes at boiling temperature and under normal pressure, the liquor is then slowly cooled to 60° C and the coloration is submitted to a complementary treatment by one of the usual emulsifier washing processes.

The textile fabric is then rinsed with water to cleanness and the material dried at temperatures above 140°

C, a procedure which eliminates possible residual carrier portions.

The bright green color shade obtained as a result, excels by an optimum levelness. The dyestuff yield is corresponding to the applied quantities of the dyestuff.

EXAMPLE 2

Mixed yarns of polyester fibers and wool (mixture 55/45) on cross-wound bobbins are dyed in a shut HT dyeing device (conceived for elevated pressure and temperatures above 100° C) at a goods-to-liquor ratio of 1:10, as follows:

The textile material is introduced into the aqueous liquor heated to 50° C, while adding 1% of a 60% acetic acid 5% of crystallized sodium acetate and 1.5 $cm^3/l$ of a methyl naphthalene carrier according to Example 1.

The thus prepared liquor is then allowed to pass first runnings with the material for 10 minutes, the very same liquor being circulated alternately for three minutes each from the outside to the interior and vice-versa from the interior to the outside. Now are added to the liquor, in dissolved or dispersed form, the dyestuffs 0.1% of Disperse Yellow 64, C.I. No. 47 023, 0.27% of the blue disperse dyestuff specified in Example 1, 0.1% of Disperse Red 60, C.I. No. 60 756

0.1% of Acid Yellow 44, C.I. No. 23 900, 0.2% of Acid Blue 123, C.I. No. 44 510 and 0.08% of Acid Red 289, C.I. No. 45 110 and the dye liquor is allowed then for another 10 minutes to circulate with the afore specified alternate flow directions. The apparatus is then closed, deaerated and finally heated to 105° C in such a way that the temperature rises every minute for 2° C. As soon as the dyeing temperature of 105° C is attained, an all-over pressure of totally 2.94 bars (hydrostatic) is put on, and the material is now dyed for 60 minutes at alternate flow direction according to the afore specified rhythm. The apparatus is now cooled slowly to 60° C and the bath allowed to flow off. After a rinsing process of the thus obtained coloration with 60° C hot water ensues an emulsifier washing and an 80° C drying process.

The light-brown color shades obtained on these yarn bobbins excel by a perfect uniformity of the inner and outer yarn layers.

EXAMPLE 3

A blended fabric of polyester fibers and rayon staple fiber, the polyester fiber portion of which shows important unlevelness (reed marks) and which is dyed with disperse dyestuff, is submitted to post-levelling on a winch at a goods-to-liquor ratio of 1:20. The aqueous liquor at 50° C used for this purpose is containing 3 $cm^3/l$ of a methyl naphthalene carrier according to Example 1 and is adjusted to a pH of 5 by means of acetic acid.

The textile material is introduced into the liquor, the temperature of which is increased at the rate of 2° C per minute up to the boiling temperature, under normal pressure, and the coloration submitted to boiling for a period of from 60 (to 90) minutes.

The obligatorily occuring diminution of the original color intensity (brightening) on the polyester fiber portion of the material, due to the post-treatment with carrier for equalization, is compensated — as usual — by the addition of 20% of the quantity of disperse dyestuffs applied for the dyeing process.

This treatment, i.e. at boiling temperature, in the presence of the methyl naphthalene carrier emulsified as per the invention, yields a flawlessly level coloration on the polyester fiber portion of the blended fabric due to the excellent equalization effect of said carrier.

The textile material is then dried at 140° C as usual.

EXAMPLE 4

A blended fabric of polyester fibers and wool (55/45), dyed with disperse and acid dyestuff, the polyester fiber portion of which shows important unlevelness (skittery, irregular appearance of the fabric) due to unstretched fiber portions or fibrous agglutinations, is submitted to subsequent equalization on an incompletely flooded HT-jet dyeing apparatus under elevated pressure and at elevated temperature and a goods-to-liquor ratio of 1:12 while using the carrier which is emulsified as per the invention.

The procedure is the following:

The partially flooded jet dyeing apparatus is charged with the textile material and an aqueous liquor with 1% of 60% acetic acid 5% of crystallized sodium acetate and 3 $cm^3/l$ of a methyl naphthalene carrier according to Example 1, the thus prepared liquor is allowed to pass first runnings at 50° C for 10 minutes with the material, the apparatus is then shut, the liquor being heated up to 106° C at the rate of 2° C per minute (corresponding to a result of 1.24 bars of all-over pressure), the circulation speed of the material being adjusted to 60m/minute and the coloration being treated at 106° C for 60 minutes. The efficiency of the carrier at the levelling-up operation resides in its capacity to form a new equilibrium of the dyestuff dispersion in respect to the liquor and the fiber; this effect leads to a brightening (reduction) of the original coloration which is compensated by adding to the liquor another 20% of the quantity of disperse dyestuff applied for the dyeing process. After the treatment the apparatus is slowly cooled to 60° C, the material rinsed at 60° C with water and dried at 140° C. The darker spots of agglutinations of unstretched polyester fibers of the textile material, which showed an uneven coloration prior to the after-treatment, are levelled-out completely so that the textile material displays a uniform and regular appearance.

When using the carrier containing the emulsifier specified by the invention, there occurs no formation of the highly undesirable carrier spots due to condensation which are however a frequent problem at carrier concentration rates of this intensity; possibly formed drops of condensate are emulsified promptly and without any residue.

When carrying out the dyeing process from the start with the carrier of the invention, the above mentioned irregularities as a consequence of affinity differences inherent to the material do not appear at all.

We claim:

1. Emulsifier for preparing dyeing accelerators (carriers) based on alkylnaphthalenes, consisting of a multicomponent system of the following composition (weight percent):

(a) 57.0 to 51.0% of a mixture of sulfonated and oxethylated alkylaryl compounds having in the alkyl radical from 9 to 12 carbon atoms, sulfonates to oxethylates 1.1 to 3:1, (b) 15.0 to 17.0% of aliphatic alcohols having from 3 to 5 carbon atoms, (c) 2.0 to 6.0% of sodium alkylsulfonamide acetic acid, (d) 2.0 6.0% of partially chlorinated paraffin hydrocarbons having from 12 to 14 carbon atoms and 1.5% of chlorine, (e) 2.0 to 6.0% of olein and (f) 18.0 to 20.0% of water, whereby the individual quantities of the different components have to form a total of 100% in each case.

2. Emulsifier according to claim 1 comprising that component (a) consists of 32 to 36% of dodecyl benzene sulfonate and 25 to 15% of nonylphenol with 23 moles of ethylene oxide per mole (weight percent).

3. Emulsifier according to claim 1 comprising that component (c) is present in quantities of from 3.0 to 4.0 weight %.

4. Emulsifier according to claim 3 comprising that component (c) is present in quantities of from 3.0 to 3.5 weight %.

5. Emulsifier according to claim 1 comprising that component (d) is present in quantities of from 3.0 to 4.0 weight %.

6. Emulsifier according to claim 5 comprising that component (d) is present in quantities of from 3.5 to 4.0 weight %.

7. Emulsifier according to claim 1 comprising that component (e) is present in quantities of from 3.0 to 5.0 weight %.

8. Emulsifier according to claim 7 comprising that component (e) is present in quantities of from 3.5 to 4.5 weight %.

9. A dyeing accelerator comprising an alkylnaphthalene and from 30 to 40 weight % of an emulsifier according to claim 1.

10. A dyeing accelerator according to claim 9, wherein the alkylnaphthalene is a monomethyl naphthalene.

11. A process for dyeing hydrophobic textile fibers with a disperse dyestuff, which comprises contacting the fibers in an exhaust process at the boiling temperature with an aqueous dye liquor containing from 0.5 to 4 $cm^3/l$ of a dyeing accelerator according to claim 9.

12. A process for dyeing of hydrophobic textile fibers with a disperse dyestuff, which comprises contacting the fibers in an exhaust process under HT conditions with an aqueous dye liquor containing from 0.5 to 3 $cm^3/l$ of a dyeing accelerator according to claim 9.

13. A process according to claim 11, wherein the aqueous dye liquor contains from 1.5 to 2.0 $cm^3/l$ of said dyeing accelerator.

14. A process for levelling unlevel colorations on hydrophobic textile fibers with disperse dyestuffs, which comprises treating the fibers at the boiling temperature with an aqueous liquor containing up to 4 $cm^3/l$ or under HT conditions with up to 3.0 $cm^3/l$, of a dyeing accelerator according to claim 9.

* * * * *